US008530852B2

(12) United States Patent
Le Galloudec

(10) Patent No.: US 8,530,852 B2
(45) Date of Patent: Sep. 10, 2013

(54) MICRO-CONE TARGETS FOR PRODUCING HIGH ENERGY AND LOW DIVERGENCE PARTICLE BEAMS

(75) Inventor: Nathalie Le Galloudec, Reno, NV (US)

(73) Assignee: Board of Regents of the Nevada System of Higher Education, on behalf of the University of Nevada, Reno, Reno, NV (US)

( * ) Notice: Subject to any disclaimer, the term of this patent is extended or adjusted under 35 U.S.C. 154(b) by 127 days.

(21) Appl. No.: 12/977,475

(22) Filed: Dec. 23, 2010

(65) Prior Publication Data

US 2011/0147607 A1 Jun. 23, 2011

Related U.S. Application Data

(60) Provisional application No. 61/284,736, filed on Dec. 23, 2009.

(51) Int. Cl.
*H01J 27/24* (2006.01)

(52) U.S. Cl.
CPC ..... *H01J 27/24* (2013.01)
USPC ..... 250/423 P

(58) Field of Classification Search
CPC ..... G21B 1/19
USPC ..... 250/423 R, 423 P
See application file for complete search history.

(56) References Cited

FOREIGN PATENT DOCUMENTS

WO 2007033060 A1 3/2007

OTHER PUBLICATIONS

Nakamura et al., 'Optimization of Cone Target Geometry for Fast Ignition' Oct. 11, 2007, Physics of Plasmas, vol. 14, p. 103105.*
Noda, A. et al., Ion Production with a High-Power Short-Pulse Laser for Application to Cancer Therapy, Proceedings of EPAC, 2002, pp. 2748-2750.
Roth, M. et al., The generation of high-quality, intense ion beams by ultra-intense lasers, Plasma Physics and Controlled Fusion, Nov. 21, 2002, pp. B99-B108, vol. 44.
Kodama, R. et al., Fast heating of ultrahigh-density plasma as a step towards laser fusion ignition, Nature, Aug. 23, 2001, pp. 798-802, vol. 412.
Dunne, Mike, Laser-Driven Particle Accelerators, Science, Apr. 21, 2006, pp. 374-376, vol. 312.
Nakamura, Tatsufumi et al., Surface-Magnetic-Field and Fast-Electron Current-Layer Formation by Ultraintense Laser Irradiation, Physical Review Letters, Dec. 20, 2004, pp. 265002-1 to 265002-4, vol. 93, No. 26.

(Continued)

*Primary Examiner* — Jack Berman
*Assistant Examiner* — Eliza Osenbaugh-Stewart
(74) *Attorney, Agent, or Firm* — Wood, Herron & Evans, LLP

(57) ABSTRACT

The present invention relates to micro-cone targets for producing high energy and low divergence particle beams. In one embodiment, the micro-cone target includes a substantially cone-shaped body including an outer surface, an inner surface, a generally flat and round, open-ended base, and a tip defining an apex. The cone-shaped body tapers along its length from the generally flat and round, open-ended base to the tip defining the apex. In addition, the outer surface and the inner surface connect the base to the tip, and the tip curves inwardly to define an outer surface that is concave, which is bounded by a rim formed at a juncture where the outer surface meets the tip.

20 Claims, 6 Drawing Sheets

(56) References Cited

OTHER PUBLICATIONS

Fuchs, J. et al., Spatial Uniformity of Laser-Accelerated Ultrahigh-Current MeV Electron Propagation in Metals and Insulators, Physical Review Letters, Dec. 18, 2003, pp. 255002-1 to 255002-4, vol. 91, No. 25.
Nakatsutsumi, M. et al., Reentrant cone angle dependence of the energetic electron slope temperature in high-intensity laser-plasma interactions, Physics of Plasmas, pp. 050701-1 to 050701-4, May 14, 2007, vol. 14, No. 5.
Dawson, John M., On the Production of Plasma by Giant Pulse Lasers, The Physics of Fluids, Jul. 1964, pp. 981-987, vol. 7, No. 7.
Nuckolls, John et al., Laser Compression of Matter to Super-High Densities: Thermonuclear (CTR) Applications, Nature, Sep. 15, 1972, pp. 139-142, vol. 239.
Renard-Le Galloudec, N. et al., Guiding, Focusing, and Collimated Transport of Hot Electrons in a Canal in the Extended Tip of Cone Targets, Physical Review Letters, May 20, 2009, pp. 205003-1 to 205003-4, vol. 102, No. 20.
Bin, J. H. et al., Influence of the target front-surface curvature on proton acceleration in laser-foil interaction, Physics of Plasmas, Apr. 20, 2009, pp. 043109-1 to 043109-5, vol. 16, No. 4.
Flippo, K. A. et al., Increased efficiency of short-pulse laser-generated proton beams from novel flat-top cone targets, Physics of Plasmas, May 30, 2008, pp. 056709-1 to 056709-12, vol. 15, No. 5.
Sentoku, Y. et al., Laser light and hot electron micro focusing using a conical target, Physics of Plasmas, Jun. 2004, pp. 3083-3087, vol. 11, No. 6.
Lasinski, B. F. et al., Particle-in-cell simulations of short-pulse, high intensity light impinging on structured targets, Physics of Plasmas, Jan. 29, 2009, pp. 012705-1 to 012705-8, vol. 16, No. 1.
Chen, Z. L. et al., Enhancement of energetic electrons and protons by cone guiding of laser light, Physical Review E, Mar. 16, 2005, pp. 036403-1 to 036403-5, vol. 71, No. 3.
Nakamura, H. et al., Superthermal and Efficient-Heating Modes in the Interaction of a Cone Target with Ultraintense Laser Light, Physical Review Letters, Jan. 30, 2009, pp. 045009-1 to 045009-4, vol. 102, No. 4.
Roth, M. et al., Fast Ignition by Intense Laser-Accelerated Proton Beams, Physical Review Letters, Jan. 15, 2001, pp. 436-439, vol. 86, No. 3.
Borghesi, M. et al., Electric field detection in laser-plasma interaction experiments via the proton imaging technique, Physics of Plasmas, May 2002, pp. 2214-2220, vol. 9, No. 5.
Basov, N. G. et al., Conditions for Heating Up of a Plasma by the Radiation From an Optical Generator, Soviet Physics JETP, Jul. 1964, pp. 123-125, vol. 19, No. 1.
Yogo, A. et al., Application of laser-accelerated protons to the demonstration of DNA double-strand breaks in human cancer cells, Applied Physics Letters, May 7, 2009, pp. 181502-1 to 181502-3, vol. 94, No. 18.
Higginson, D.P. et al., Flexible Large Batch Production of High Energy Density Physics Targets, Abstract Submitted for the DPP06 Meeting of The American Physical Society, Jul. 20, 2006, 1 page.
Tummler, J. et al., High-repetition-rate chirped-pulse-amplification thin-disk laser system with joule-level pulse energy,Optics Letters, Apr. 22, 2009, pp. 1378-1380, vol. 34, No. 9.
Reyntjens, S. et al., Focused ion beam induced deposition: fabrication of three-dimensional microstructures and Young's modulus of the deposited material, Journal of Micromechanics and Microengineering, 2000, pp. 181-188, vol. 10.
Patel, P. K. et al., Isochoric Heating of Solid-Density Matter with an Ultrafast Proton Beam, Physical Review Letters, Sep. 19, 2003, pp. 125004-1 to 125004-4, vol. 91, No. 12.
Pegoraro, F. et al., Production of ion beams in high-power laser-plasma interactions and their application, Laser and Particle Beams, 2004, pp. 19-24, vol. 22.
Renard-Le Galloudec, N. et al., Controlled reproducible alignment of cone targets and mitigation of preplasma in high intensity laser interactions, Review of Scientific Instruments, Aug. 25, 2008, pp. 083506-1 to 083506-4, vol. 79, No. 8.
Renard-Le Galloudec, N. et al., Developments of laser targets and operations of the target fabrication laboratory, Nevada Terawatt Facility Annual Report, 2006, 4 pages.
Koenig, M. et al., High pressures generated by laser driven shocks: application to planetary physics, Nuclear Fusion, Nov. 26, 2004, pp. S208-S214, vol. 44.
Bulanov S. V. et al., Feasibility of Using Laser Ion Accelerators in Proton Therapy, Plasma Physics Reports, 2002, pp. 453-456, vol. 28, No. 5.
Sentoku, Y. et al., Isochoric heating in heterogeneous solid targets with ultrashort laser pulses, Physics of Plasmas, Dec. 4, 2007, pp. 122701-1 to 122701-6, vol. 14, No. 12.
Nishiuchi, M. et al., Focusing and spectral enhancement of a repetition-rated, laser-driven, divergent multi-MeV proton beam using permanent quadrupole magnets, Applied Physics Letters, Feb. 9, 2009, pp. 061107-1 to 061107-3, vol. 94, No. 6.
Tabak, Max et al., Ignition and high gain with ultrapowerful lasers* , Physics of Plasmas, May 1994, pp. 1626-1634, vol. 1, No. 5.
Snavely, R. A. et al., Laser generated proton beam focusing and high temperature isochoric heating of solid matter, Sep. 21, 2007, pp. 092703-1 to 092703-5, vol. 14, No. 9.
Schollmeier, M. et al., Controlled Transport and Focusing of Laser-Accelerated Protons with Miniature Magnetic Devices, Physical Review Letters, Aug. 1, 2008, pp. 055004-1 to 055004-4, vol. 101, No. 5.
Roth, M. et al., Energetic ions generated by laser pulses: A detailed study on target properties, Physical Review Special Topics—Accelerators and Beams, Jun. 4, 2002, pp. 061301-1 to 061301-8, vol. 5, No. 6.
Wilks, S. C. et al., Energetic proton generation in ultra-intense laser-solid interactions, Physics of Plasmas, Feb. 2001, pp. 542-549, vol. 8, No. 2.
Rendard-Le Galloudec, N. et al., New micro-cones targets can efficiently produce higher energy and lower divergence particle beams, Laser and Particle Beams, 2010, pp. 513-519, vol. 28.
Toncian, Toma et al., Ultrafast Laser-Driven Microlens to Focus and Energy-Select Mega-Electron Volt Protons, Science, Apr. 21, 2006, pp. 410-413, vol. 312.
Kodama, R. et al., Fast plasma heating in a cone-attached geometry—towards fusion ignition, Nuclear Fusion, Nov. 26, 2004, pp. S276-S283, vol. 44.
Spencer, I. et al., Laser generation of proton beams for the production of short-lived positron emitting radioisotopes, Nuclear Instruments and Methods in Physics Research B, 2001, pp. 449-458, vol. 183.

* cited by examiner

MICRO-CONE TARGETS FOR PRODUCING HIGH ENERGY AND LOW DIVERGENCE PARTICLE BEAMS

CROSS REFERENCE TO RELATED APPLICATIONS

This application claims the benefit of U.S. Provisional Application No. 61/284,736, filed Dec. 23, 2009, the disclosure of which is hereby incorporated by reference herein in its entirety.

GOVERNMENT FUNDING

This invention was made with support under Grant Number DE-FC52-03NA00156, awarded by the U.S. Department of Energy; the United States federal government, therefore, has certain rights in the invention.

TECHNICAL FIELD

The present invention relates to targets and, more specifically, to micro-cone targets for producing high energy and low divergence particle beams.

BACKGROUND

Cone-shaped targets appeared in laser target interaction after a series of key steps in the pursuit of fusion. In 1963, applications of fusion were starting to be studied (Basov, N. G. et al, Laser Driven Thermonuclear Reactions, Vol. 2, pp. 1373-1379; Paris et al., Phys. Fluids 7, 981-987; Hora et al. (1970). Conference Digest, 6th Quantum Electronics Conference, Kyoto, pp. 10-11B). Each article herein is expressly incorporated by reference in its entirety. In 1972, the laser implosion concept to produce fusion was conceived, and inertial confinement fusion research was born (John Nuckols et al., Nature, 239, 139, 1972). Some decades later, the concept of fast ignition was introduced as well as the idea of a cone target for fast ignition to allow the laser beam to get far enough into the compressed plasma to produce a fast electron beam that would deliver the ignition spark at the right place (M. Tabak et al., Phys. Plasmal, 1626 (1994); R. Kodama et al., Nature 412, 798-802 (2001)). These concepts have since been expanded. While cone geometries show an increased efficiency (Z. L Chen et al., Phys Rev E 71, 036403 (2005), and shaped flat targets have the ability to shape proton beams (S. C. Wilks et al., Phys Plasma 8, 542 (2001), higher proton beam maximum energies and lower beam divergences are still desired for a variety of laser applications.

It would thus be desirable to provide a target of specified dimensions that can produce a proton beam of a higher maximum energy and a lower divergence than current targets and that can produce proton beams that are not limited by the characteristics of the laser.

SUMMARY

The present invention relates to micro-cone targets for producing high energy and low divergence particle beams.

The micro-cone targets are specifically dimensioned such that with specific interaction conditions they can produce and focus particle beams of higher maximum energy and lower angular divergence than, e.g., flat targets. This is particularly relevant to fast ignition, small compact particle beams, medical applications, focused ion and/or electron beam microscopes, and also demonstrates a potential to produce proton beams that are no longer limited by the characteristics of the laser.

In one embodiment, a micro-cone target is provided that includes a substantially cone-shaped body having an outer surface, an inner surface, a generally flat and round, open-ended base, and a tip defining an apex. The cone-shaped body tapers along its length from the generally flat and round, open-ended base to the tip defining the apex. In addition, the outer surface and the inner surface connect the base to the tip, and the tip curves inwardly to define an outer surface that is concave, which is bounded by a rim formed at a juncture where the outer surface meets the tip.

In another embodiment, a micro-cone target is provided that includes a substantially cone-shaped body including an outer surface, an inner surface, a generally flat and round, open-ended base, and a tip defining an apex. The cone-shaped body tapers along its length from the generally flat and round, open-ended base to the tip defining the apex. In addition, the outer surface and the inner surface connect the base to the tip, and the tip curves inwardly to define an inner surface that is convex and an outer surface that is concave, which is bounded by a rim formed at a juncture where the outer surface meets the tip. The target also is composed of a metal selected from aluminum, titanium, iron, cobalt, nickel, copper, zinc, molybdenum, silver, tantalum, tungsten, platinum, gold or any combination thereof.

In yet another embodiment, a method for producing a particle beam from a micro-cone target is provided, which includes projecting a laser through a generally flat and round, open-ended base and onto an inner surface of a substantially cone-shaped body of the micro-cone target. The cone-shaped body further includes an outer surface, and a tip defining an apex, and tapers along its length from the generally flat and round, open-ended base to the tip defining the apex. In addition, the outer surface and the inner surface connect the base to the tip, and the tip curves inwardly to define an outer surface that is concave, which is bounded by a rim formed at a juncture where the outer surface meets the tip. The method further includes emitting a particle beam from the laser from the tip defining the apex of the target.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention. This patent or application file contains at least one drawing executed in color. Copies of this patent or patent application publication with color drawing(s) will be provided by the Office upon request and payment of the necessary fee.

DETAILED DESCRIPTION OF SPECIFIC EMBODIMENTS

Figure 1:
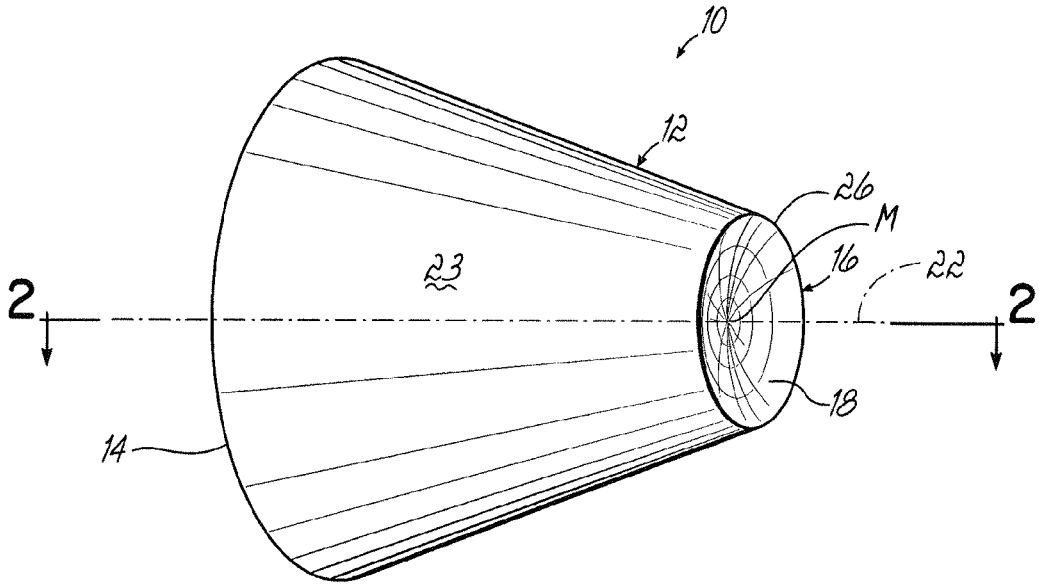
FIG. 1 is a perspective view of a micro-cone target in accordance with embodiments of the invention.
Figure 2:
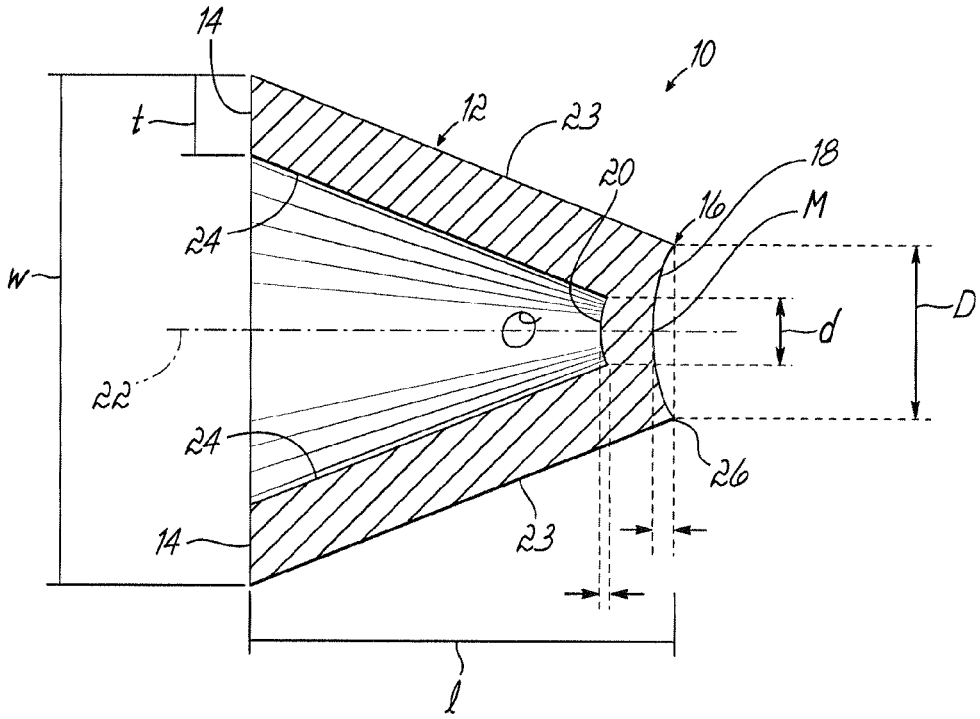
FIG. 2 is a cross-sectional view of FIG. 1 taken along line 2-2.

FIGS. 1 and 2 show a micro-cone target 10 in accordance with embodiments of the present invention. The micro-cone target 10 is specifically dimensioned to produce proton beams of a high maximum energy, as compared to maximum energies produced by flat targets discussed further below, and a low divergence, such as less than 25 degree full beam angle. The micro-cone target 10 includes a substantially cone-shaped body 12 that tapers smoothly from a generally flat and round, open-ended base 14 to a tip 16 defining an apex. The tip 16 curves inwardly to define an outer surface 18 that is concave and an inner surface 20 that is convex. The cone-shaped body 12 further includes an outer surface 23 and an inner surface 24, which taper inwardly from and connect the base 14 to the tip 16. A rim 26 is formed at the juncture where the outer surface 23 meets the tip 16 and further bounds the outer concave surface 18.

With respect to dimensions, as best shown in FIG. 2, the length (L) of the target 10 is about 90 μm and its width (W) at the base 14 is about 90 μm. However, the length (L) of the target 10 can be from about 90 μm to about 1 mm and the width (W) of the target 10 at its base 14 can be from about 50 μm to about 500 μm. In one example, the full inside angle (Θ) of the cone-shaped body 12, as shown, is desirably kept near 20 degrees. It should be understood, however, that the angle (Θ) can range from about 10 degrees to less than 90 degrees. In another example, the angle (Θ) can range from about 10 degrees to about 30 degrees. Keeping in mind the aforementioned parameters for the cone-shaped target 10 including the length (L), width (W), and the inside angle (Θ) of the tip 16 of the cone-shaped body 12, a general formula for providing desirable dimensions for the target 10 may be presented as follows: length=((width/2)/sin(angle(Θ))).

With continuing reference to FIG. 2, the diameter (d) of the inner convex surface 20 is about 10 μm and the diameter (D) of the outer concave surface 18 of the tip 16 is about 30 μm. However, the diameter of the inner convex surface 20 can be from about 5 μm to about 50 μm, and the diameter of the outer convex surface 18 can be from about 20 μm to about 100 μm. The body 12 of the target 10 also is approximately 10 μm thick (t). In one example, the thickness can range from about 1 μm to 40 μm. In another example, the thickness can range from about 5 μm to 40 μm. A thicker body 12 generally provides greater outer dimensions for the cone-shaped target 10.

In addition, the midpoint (M) of the curvature of the outer surface 18 and inner surface 20 is generally perpendicular to a central axis 22 of the target 10. In terms of radius of curvature, the radius of curvature for the outer concave surface 18, as shown, is about 82 μm with a 4 μm dip, or drop, in the outer concave surface. In one example, the radius of curvature for the outer surface 18 may be from about 15 μm to 100,000 μm. In another example, the radius of curvature can be from about 82 μm to about 100,000 μm. The radius of curvature of the inner surface 20 follows closely that of the outer surface 18. In this example, the shape of the inner convex surface 20 is depicted as mirroring that of the outer concave surface 18.

In terms of materials, the target 10 can be formed from a metal including aluminum, titanium, iron, cobalt, nickel, copper, zinc, molybdenum, silver, tantalum, tungsten, platinum, or gold, or any combination thereof, ceramic, plastic, glass, diamond, or any combination thereof, including in layers or in doping. In one example, the target 10 is composed of at least two metals, e.g., aluminum and copper. In another example, the outer surface 23 and outer concave surface 18 may be a different material than the inner surface 24 and inner convex surface 20. For example, the outer surface 23 and outer concave surface 18 can be composed of aluminum and the inner surface 24 and inner convex surface 20 can be composed of copper. In general, with layering, the outside layer is of a lower Z, i.e., atomic number, than the inside layer.

The micro-cone target 10 may be formed or machined in any manner known to those skilled in the art. In one example, vapor deposition is employed to form the target 10. For example, a wax or resin can be melted into a holder. The wax or resin then can be shaped with a tool having a specified shape of the target 10 to form a mold. In a vapor deposition chamber, a first material can be used to provide a layer, or coating, of a specified thickness on the inside of the mold to form the outer surface 23 and outer concave surface 18 of the target 10. The first material can be a metal, e.g., aluminum and the thickness can be 1 micron or greater and can be dependent on the size of the mold, for example. A second material can be deposited in the vapor deposition chamber to provide another layer, or coating, of a specified thickness onto the first material to form the interior surface 24 and inner convex surface 20 of the target 10. The second material can be a metal, e.g., copper. The thickness can be 0.5 micron or greater and can be dependent on the size of the mold, for example. The resulting target 10, thus, is composed of a 1 micron (or thicker) layer of aluminum on its outside and a 0.5 micron (or thicker) layer of copper on its inside. The target 10 can then be cooled and the wax or resin can be released therefrom using an appropriate solvent, e.g., acetone.

Figure 3A:
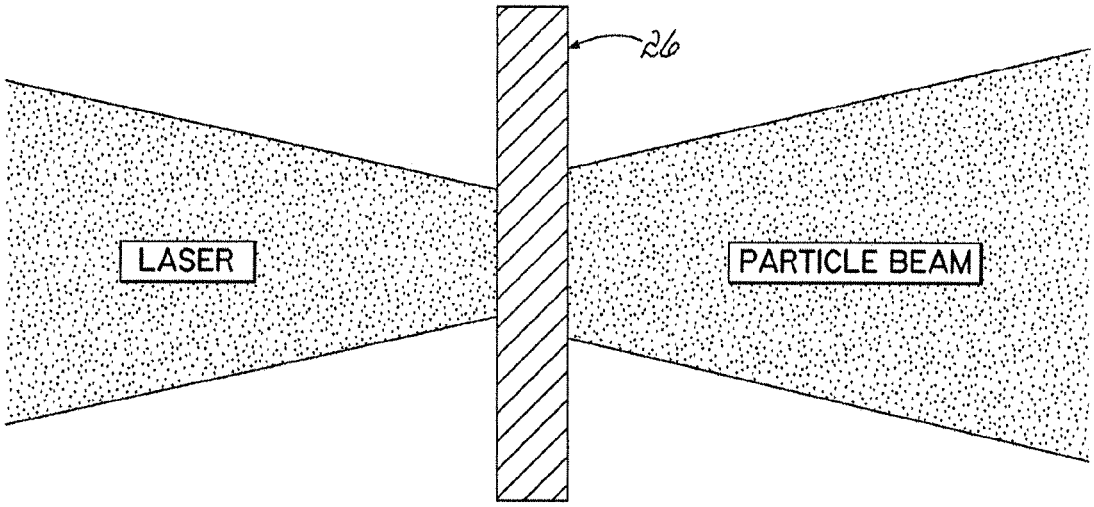
FIG. 3A is a cross-sectional view of a standard flat target illustrating a laser beam incident on the target and the resulting divergence of the particles.
Figure 3B:
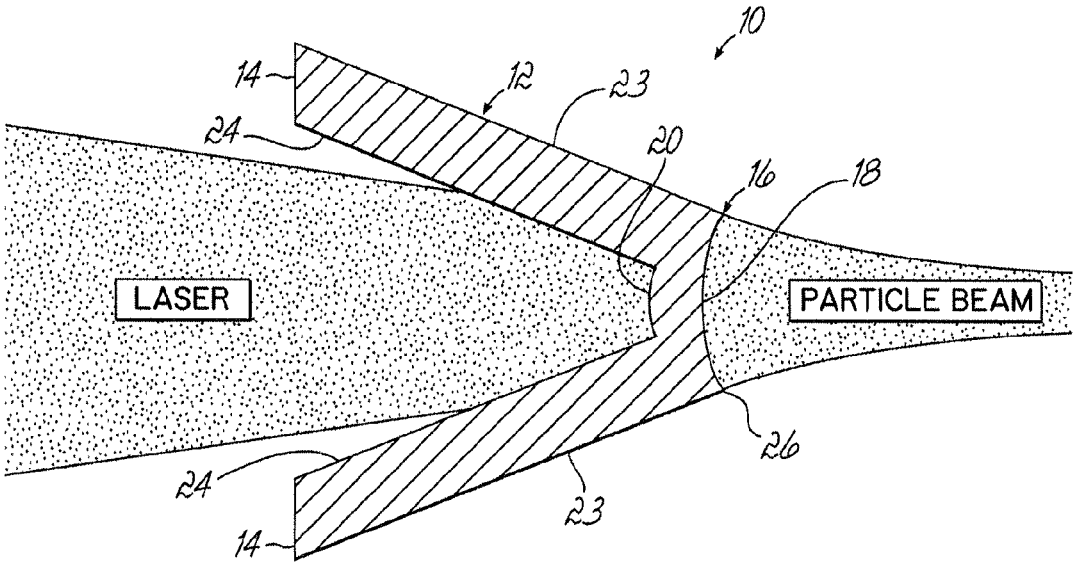
FIG. 3B is a cross-sectional view of the micro-cone of FIG. 2 illustrating a laser beam incident on the micro-cone and the resulting divergence of the particles.

With further reference now to FIGS. 2, 3A, and 3B, because of the physics occurring in a cone, some criteria need to be met for the micro-cone target 10 to provide its full potential. For example, the cone-shaped target 10 needs to be accurately aligned such that the axis of a laser is co-linear with the central axis 22 of the target 22 as it enters through the base 14. The laser then hits the inner surface 24 of the target 22 when its diameter is about 3 to 4 times the size of the inner convex surface 20 of the tip 16. Under low pre-plasma conditions, the laser 'sees' a conical shape and then the target 10 micro-focuses the laser light at the tip 16. At the same time, the laser interacts with the inner surface 24 of the target 10, creates electrons, and guides them along to the tip 16 where the electron beam gets out. This increases dramatically the electron density in the tip 16, enables a higher conversion efficiency of laser light into very energetic or hot electrons, and, thus, enhances both electrons and protons. Making use of the inner surface 24 of the target 10 by allowing the laser to spread on it reduces greatly the amount of pre-plasma filling the interior of the target, thus enabling the use of cone-shaped targets 10 for proton acceleration.

It is also understood here that the cone-shaped target 10, not the laser, defines the beam diameter. For example, a smaller cone angle can produce more energetic electrons as compared to a larger angle or more open cone. In addition, the cone-shape provides an increased absorption of the laser light as compared to flat target 26 (FIG. 3A), as further discussed below, which makes them more efficient. Also, the multiple bounces of the laser onto the inner surface 24 of the target 10 before it reaches the tip 16 makes the tip 16 a laser imprint free area, enabling more uniform beams. The particle beam also has the potential to be smaller or bigger than the laser best focus by defining the size of the target 10.

Concerning the curvature in the tip 16 of the target 10, the curvature creates a modification of the divergence of the output particle beam and this can be adjusted by changing the amount of curvature. The net result is a beam with desirable characteristics for fast ignition, laser based accelerators, proton beams for proton radiography of plasmas, isochoric heating shocks, proton therapy, microbeam radiation therapy, positron emission tomography, focused ion beam milling machines, ion beam microscopes and dual beam electron/ion microscopes. For applications such as proton therapy, ion milling machines and microscopes, a micro magnetic device can separate the electron and or proton beam from the x-rays.

A 2-D collisionless Particle-In-Cell (PIC) was utilized for the cone-shaped target 10 so as to run simulations and assess the electromagnetic fields structures and proton beam characteristics in comparison with that of flat target 26. Several intensities were run to span the range available to short pulse lasers.

For the simulations, the simulations box is 150 μm long to capture the emitted particles. The incident laser pulse has a 1 μm wavelength, a pulse duration of 40 fs and a transverse spot size of 21 μm FWHM at $3\times10^{18}$ W/cm$^2$ with a Gaussian temporal and transverse spatial profile. The pulse is injected to the left of a 120×150 μm box. The laser interacts with the target at normal incidence, with its polarization plane in the simulation plane. The peak of the pulse enters the box 40 fs after the beginning of the calculation. The initial target density is 40 times higher than the relativistic critical density, $a_0 n_c$, where $a_0$ is the normalized laser amplitude and $n_c$ is the critical density ($n_c=1.1\times10^{21}/\lambda$, (μm)$^2$ cm$^{-3}$, λ is the laser wavelength). The plasma, composed of aluminum ions and electrons, is initially fully ionized. The mesh size is $\Delta x=\Delta y=40$ nm with 40 deuteron ions and 40 electrons per cell. The time step equals 0.132 fs. The preplasma used in the simulation fills the interior of the cone-shaped target 10 and has a density 1% to $n_c$ over 50 microns with a characteristic length of 1 μm.

Figure 4A:
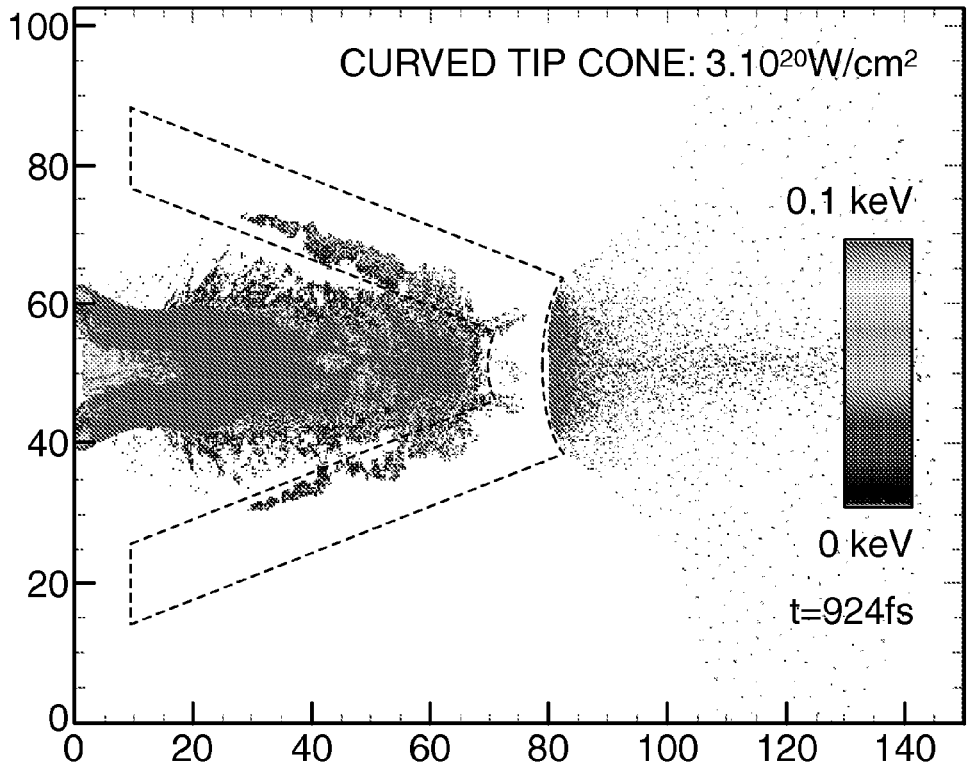
FIG. 4A depicts a proton energy density, in color, for the micro-cone target of FIG. 1 at $3.10^{20}$ W/cm$^2$.
Figure 4B:
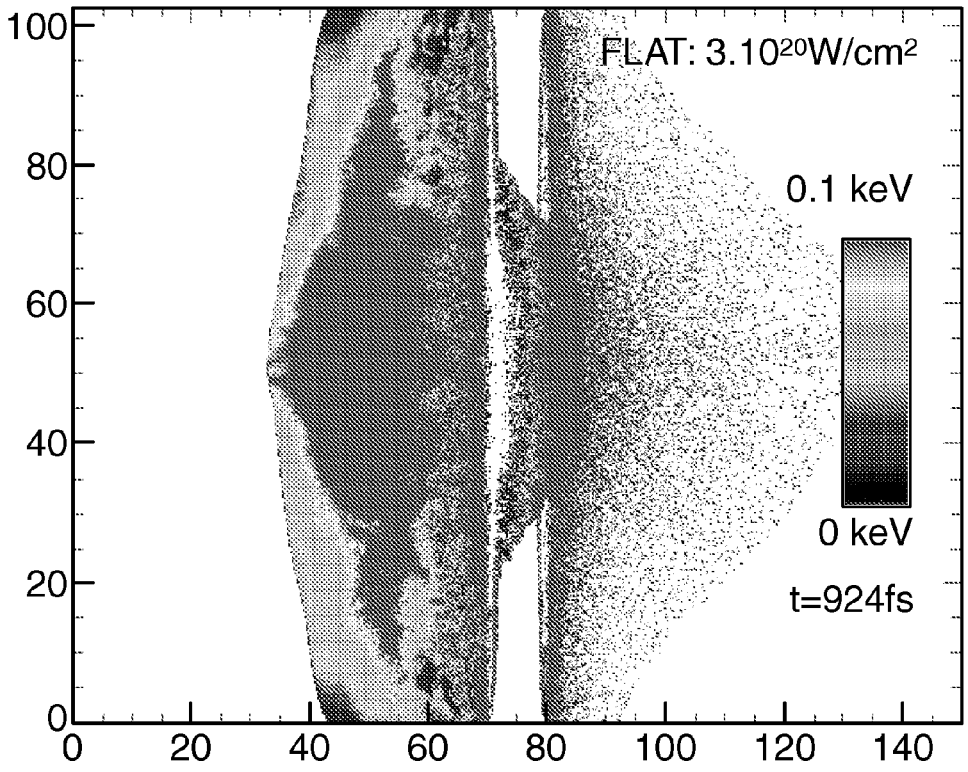
FIG. 4B depicts a proton energy density, in color, for the flat target of FIG. 3A for the same laser intensity.

FIG. 4A shows the 2D proton energy density for a 10 μm thick curved-tip 16 cone-shaped target 10 in a high intensity case at $3.10^{20}$ W/cm$^2$. FIG. 4B shows the same 2D proton energy density for a 10 μm flat target 26 in the same high intensity case. Based thereon, the protons are much more confined in the cone-shaped target 10 than in the flat target 26 where they tend to diffuse laterally. Indeed, the particles from the target 10 are much more collimated than for the flat target 26, thus the density of particles on axis is higher.

Figure 5A:
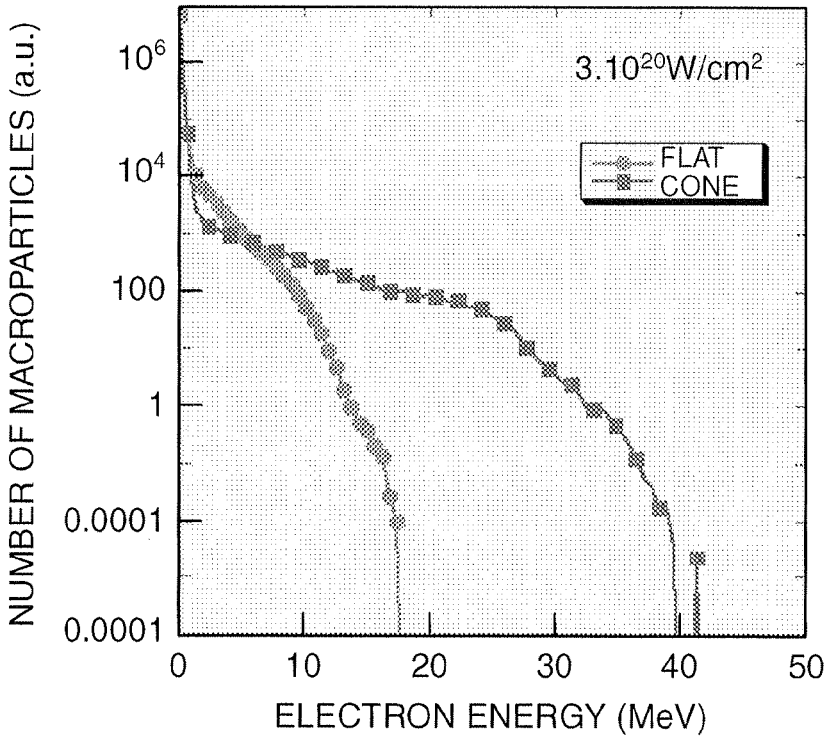
FIG. 5A depicts an electron energy spectrum for the micro-cone target of FIG. 1 and the standard flat target of FIG. 3A at $3.10^{20}$ W/cm$^2$.
Figure 5B:
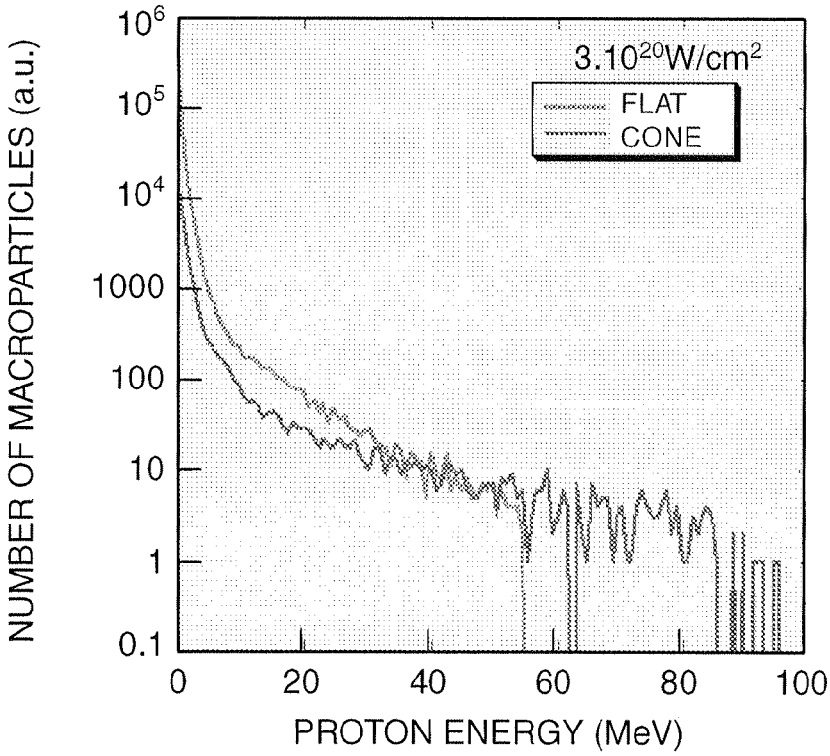
FIG. 5B depicts a proton energy spectrum for the micro-cone target of FIG. 1 and the standard flat target of FIG. 3A at $3.10^{20}$ W/cm$^2$.

FIGS. 5A and 5B confirms that the cone-shaped target 10 is a more efficient structure. FIG. 5A shows the electron energy spectrum for the micro-cone target of FIG. 1 and the standard flat target of FIG. 3A at $3.10^{20}$ W/cm$^2$; and FIG. 5B shows the proton energy spectrum for the micro-cone target of FIG. 1 and the standard flat target of FIG. 3A at $3.10^{20}$ W/cm$^2$. Both electrons (FIG. 5A) and protons (FIG. 5B) are accelerated to higher energies in a higher number for the cone-shaped target 10.

Figure 6A:
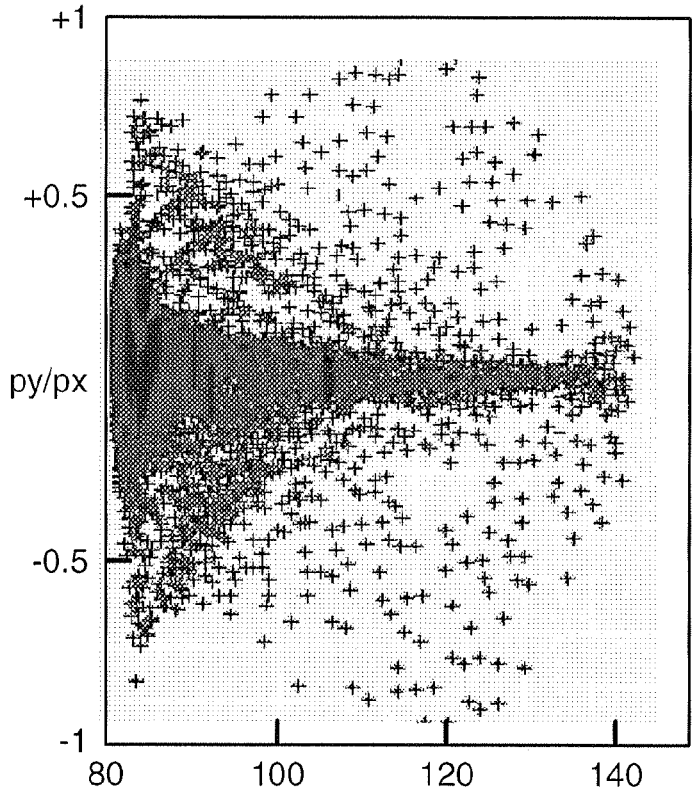
FIGS. 6A and 6B depict two-dimensional maps of the divergence of the protons propagating in the same direction as the laser for respectively the micro-cone target of FIG. 1 and the standard flat target of FIG. 3A.
Figure 6B:
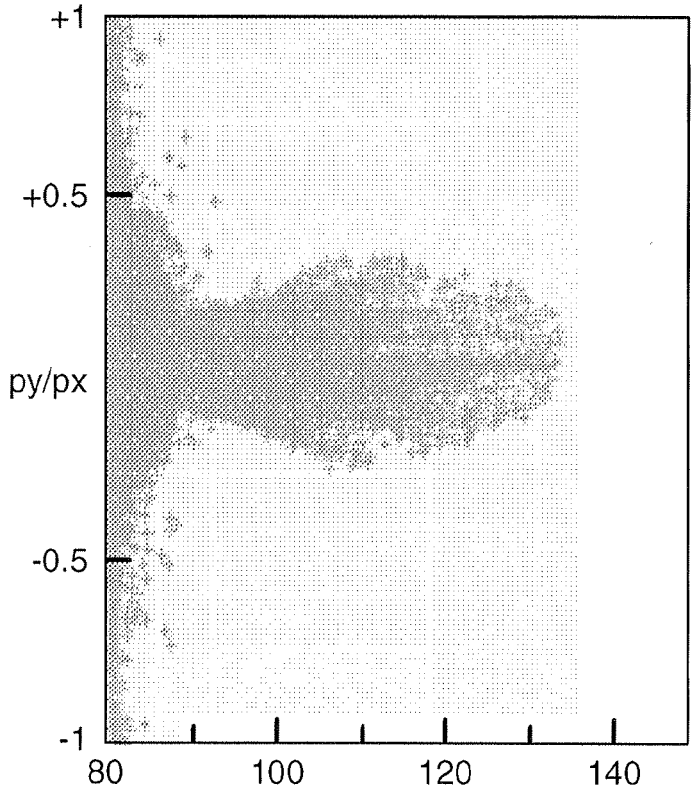
Figure 7:
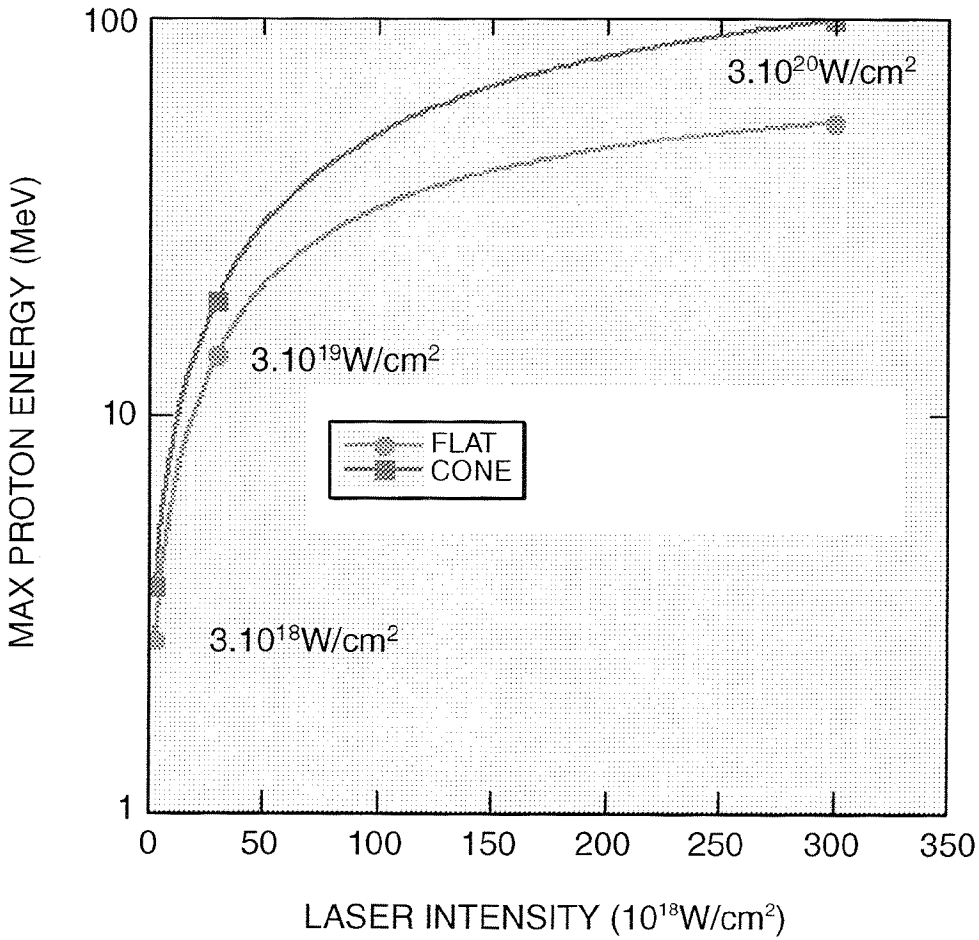
FIG. 7 is a graph illustrating the maximum proton energies for three laser intensities from both the micro-cone target of FIG. 1 and the standard flat target of FIG. 3A.

FIGS. 6A and 6B show the divergence of the proton beam from respectively the cone-shaped target 10 and the flat target 26 at t=924 fs. This clearly shows the ability to control the divergence. And in FIG. 7, a scan of different intensities representing the range of intensities available with short pulse lasers shows that a higher intensity ($3.10^{20}$ W/cm$^2$) enhances the increased maximum energy of the protons compared to lower intensities.

Accordingly, the micro-cone target 10 of the present invention produces proton beams of a desirable high maximum energy and controllable, desirably lower divergence. And such target 10 is not limited by the size or quality of the laser focal spot, the contrast of the laser pulse, or the f number of the focusing optic. Indeed, the target 10 defines the proton beams characteristics.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. Thus, the invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A micro-cone target comprising:

a substantially cone-shaped body including an outer surface, an inner surface, a generally flat and round, open-ended base, and a tip defining an apex, and wherein the cone-shaped body tapers along its length from the generally flat and round, open-ended base to the tip defining the apex, the outer surface and the inner surface connect the base to the tip, and the tip curves inwardly to define an outer surface that is concave, which is bounded by a rim formed at a juncture where the outer surface meets the tip.

2. The target of claim 1 wherein the tip curves inwardly to define the outer surface that is concave and an inner surface that is convex.

3. The target of claim 2 wherein the diameter of the inner convex surface is from about 5 μm to about 50 μm.

4. The target of claim 1 wherein the length of the target is from about 90 gm to about 1 mm, and the width of the base of the target is from about 50 μm to about 500 μm.

5. The target of claim 1 wherein an inside angle of the cone-shaped body is from about 10 degrees to about 30 degrees.

6. The target of claim 1 having length dimensions according to the following formula:

$$\text{length} = ((\text{width}/2)/\sin(\text{angle}(\Theta))).$$

7. The target of claim 1 wherein the cone-shaped body has a thickness of from about 5 μm to 40 μm.

8. The target of claim 1 wherein a midpoint of curvature of the outer surface is generally perpendicular to a central axis of the target.

9. The target of claim 1 wherein the diameter of the outer concave surface is from about 20 μm to about 100 μm.

10. The target of claim 1 composed of a metal selected from aluminum, titanium, iron, cobalt, nickel, copper, zinc, molybdenum, silver, tantalum, tungsten, platinum, gold or any combination thereof, ceramic, plastic, glass, diamond, or any combination thereof.

11. The target of claim 1 wherein the outer surface of the body is composed of a metal and the inner surface of the body is composed of a different metal, each metal selected from aluminum, titanium, iron, cobalt, nickel, copper, zinc, molybdenum, silver, tantalum, tungsten, platinum, or gold.

12. The target of claim 1 formed via machining or deposition techniques.

13. A micro-cone target comprising:

a substantially cone-shaped body including an outer surface, an inner surface, a generally flat and round, open-ended base, and a tip defining an apex, and wherein the cone-shaped body tapers along its length from the generally flat and round, open-ended base to the tip defining the apex, the outer surface and the inner surface connect the base to the tip, and the tip curves inwardly to define an inner surface that is convex and an outer surface that is concave, which is bounded by a rim formed at a juncture where the outer surface meets the tip, and wherein the target is composed of a metal selected from aluminum, titanium, iron, cobalt, nickel, copper, zinc, molybdenum, silver, tantalum, tungsten, platinum, gold or any combination thereof

14. The target of claim 13 wherein an inside angle of the cone-shaped body is from about 10 degrees to about 30 .

15. The target of claim 13 having length dimensions according to the following formula:

$$\text{length} = ((\text{width}/2)/\sin(\text{angle}(\Theta))).$$

16. A method for producing a particle beam from a micro-cone target comprising:

projecting a laser through a generally flat and round, open-ended base and onto an inner surface of a substantially cone-shaped body of the micro-cone target, the cone-shaped body further including an outer surface, and a tip defining an apex, wherein the cone-shaped body tapers along its length from the generally flat and round, open-ended base to the tip defining the apex, the outer surface and the inner surface connect the base to the tip, and the tip curves inwardly to define an outer surface that is concave, which is bounded by a rim formed at a juncture where the outer surface meets the tip; and emitting a particle beam from the laser from the tip defining the apex of the target.

17. The method of claim 16 wherein an axis of the laser is co-linear with a central axis of the target as it is projected through the base and onto the inner surface.

18. The method of claim 16 wherein the tip curves inwardly to define the outer surface that is concave and an inner surface that is convex and wherein the laser has a diameter that is about 3 to 4 times the size of the inner convex surface of the tip when the laser projects onto the inner surface of the target.

19. The method of claim 16 wherein an inside angle of the cone-shaped body is from about 10 degrees to about 30 degrees.

20. The method of claim 16 wherein the target is composed of a metal selected from aluminum, titanium, iron, cobalt, nickel, copper, zinc, molybdenum, silver, tantalum, tungsten, platinum, gold or any combination thereof, ceramic, plastic, glass, diamond, or any combination thereof.

* * * * *